US005678706A

United States Patent [19]

Husak et al.

[11] Patent Number: 5,678,706

[45] Date of Patent: Oct. 21, 1997

[54] MODULAR FURNITURE

[75] Inventors: Vaclav Husak; Jiri Kocandrle, both of Prague, Czech Rep.

[73] Assignee: Rollpa International, S.R.O., Czech Rep.

[21] Appl. No.: 367,726

[22] Filed: Jan. 3, 1995

[30] Foreign Application Priority Data

Jan. 19, 1994 [CZ] Czech Rep. ..... 1830-94

[51] Int. Cl.[6] ..... A47B 43/00

[52] U.S. Cl. ..... 211/189; 403/171

[58] Field of Search ..... 211/189, 186, 211/187, 182; 108/56.1, 51.3, 153; 403/171, 177, 292; 229/100, 121; 428/34.2, 577, 582; 383/119

[56] References Cited

U.S. PATENT DOCUMENTS

| | | | |
|---|---|---|---|
| 2,839,320 | 6/1958 | Hill | 403/172 |
| 3,074,203 | 1/1963 | Paksy | 403/171 X |
| 3,218,097 | 11/1965 | Bowers et al. | 403/295 |
| 3,986,316 | 10/1976 | Blodee | 211/189 X |
| 4,112,853 | 9/1978 | Tisbo et al. | 403/172 X |
| 4,157,801 | 6/1979 | Elmer | 403/295 X |
| 4,187,649 | 2/1980 | Chaffee | 403/171 X |
| 4,353,661 | 10/1982 | Ruther | 403/171 |
| 4,410,292 | 10/1983 | Ruther | 403/24 |
| 4,815,727 | 3/1989 | Kiribuchi | 403/172 X |
| 5,067,418 | 11/1991 | Carter | 108/56.1 X |
| 5,167,994 | 12/1992 | Paulson | 428/34.2 |
| 5,531,165 | 7/1996 | Taravella et al. | 108/51.3 |

FOREIGN PATENT DOCUMENTS

623 U 8/1993 Czech Rep. .

OTHER PUBLICATIONS

Brochure for Quadro Spiel–und Sportgeräte GmbH & Co. KG, published in West Germany in 1989.

*Primary Examiner*—Alvin C. Chin-Shue
*Assistant Examiner*—Sandra Snapp
*Attorney, Agent, or Firm*—William A. Knoeller

[57] ABSTRACT

Modular furniture is disclosed wherein a system of tubes, preferably made from laminated paper or paperboard, build a system of rectangular frame-like subassemblies. The fill-in panels used in the subassemblies are of the type of hollow prisms, usually rectangular prisms, open at both ends and provided at the open ends with inwardly rounded side edges compatible in size with the surface of the structural tubes. Several embodiments of the fill-in panels are disclosed inclusive of cardboard blanks from which they may be produced. The invention further advances the art of inexpensive modular furniture and its manufacture.

17 Claims, 6 Drawing Sheets

MODULAR FURNITURE

BACKGROUND OF THE INVENTION

The present invention relates to the art of modular furniture, and in particular to fill-in panels for use in modular furniture sets which include a frame structure comprised of cylindric rod-like structural components and of angular connectors connecting the ends of the rod-like structural components to each other to thus form the frame structure.

Modular furniture kits are known which comprise three-dimensional frame structures. They include tubular components which are preferably, but not necessarily, made from paper or paperboard. The tubes are held together by a series of corner connectors. The connectors, compatible with the inside diameter of the tubular members, are inserted, at a suitable interference in the ends of two or more adjacent tubular members to define corners of series of generally rectangular frame sections.

The three-dimensional frame structure forms the supporting structure of the modular furniture. It supports various fill-in elements such as horizontal shelves, vertical back or side boards such as partitions, door panel frame sections etc.

The shelves or other panel units for use in this type are support panels of various structure depending upon the expected load of the panel units. They range from plain light weight carton or paperboard panels (which may be provided with suitable reinforcement), over wood chip boards, to plastic, metal or glass panels of regular structure.

The shelves or back board panels and partitions in small cabinets used in this type of furniture are typically paperboard panels provided, at their opposed edges, with mounting flanges. The flanges serve the purpose of reinforcing the respective edges. They define, with the main panel, a wide rectangular channel-shaped structure. The end portions of the flanges are provided with semicircular cutouts compatible with the outer contour of the tubular frame members. These panels have insufficient strength and stiffness and are suitable only for use as the back boards of the cabinets or other panel members which do not carry any load.

SUMMARY OF THE INVENTION

It is an object of the present invention to advance the art of modular furniture of the above type by providing fill-in panel members for the modular furniture of the above type which panel members would be made from material similar to that from which the major part of the remaining sections of the modular furniture unit is made. It is also an object of the invention to provide such panel members which would have improved strength characteristics and would be relatively easy and inexpensive to manufacture.

In general terms, and defining the invention in one aspect thereof, a modular furniture kit is provided which comprises: a plurality of open ended, generally cylindric tubular support modules; a plurality of angular corner connectors, each connector comprising a plurality of stems projecting from a center of the connector and disposed at a generally right angle relative to each other, said stems being adapted for inserting, at suitable interference, each into one end of one of said support modules to thus firmly connect two of said support modules to each other to form a structure comprising a plurality of rectangular frame sections; a fill-in panel of a generally rectangular configuration compatible with said support modules for securement of the panel in one of said rectangular frame sections. When the panel is assembled, it includes two spaced-apart, generally parallel and generally planar face boards comprised of a first board and a second board, said boards defining faces of said panel; and four peripheral edge portions. The four peripheral edge portions are comprised of (1) a pair of opposed edge wall portions integral with the first and/or second board and defining two opposed edges of the panel, (2) a first generally rectangular hollow edge section defined by a first edge of each of said first and second boards and by a first end edge of each of said edge wall portions; (3) a second generally rectangular hollow edge section opposed to the first edge section and defined by a second end edge of each of said first and second boards and by a second edge of each of said edge wall portions. The first and second end edges of each of the edge wall portions are concavely rounded at a radius generally corresponding to the outside radius of the support modules of the respective frame section. Accordingly, in an assembled state, the rounded edge wall portions at the engage respective support modules at opposed sides of said rectangular space thus holding the panel in said rectangular frame section with one of the boards to each side of the supporting tubular members.

In another aspect, the invention provides a panel of a generally rectangular configuration for securement in a rectangular frame section of a modular furniture or the like structure defined by cylindric frame members. The panel defines the general shape of a flattened, hollow, rectangular prism-like structure open at both ends and including: (a) two spaced-apart, generally parallel and generally planar face boards comprised of a first board and a second board, said boards defining opposite faces of said panel; and (b) four peripheral edge portions comprised of: (1) a pair of opposed, generally solid edge wall portions integral with the first and/or second board and defining two opposed edges of the panel; (2) a first generally rectangular hollow edge defined by a first edge of each of said first and second boards and by a first end edge of each of said edge wall portions; (3) a second generally rectangular hollow edge section opposed to the first edge section and defined by a second end edge of each of said first and second boards and by a second edge of each of said edge wall portions; (c) said first and second end edges of each of said edge wall portions being concavely rounded at a radius generally corresponding to the outside radius of the support modules of said frame section.

In a yet another aspect, the invention provides a carton or the like blank for providing a fill-in panel of a quadrangular, particularly rectangular configuration compatible with a rectangular frame section of a modular furniture or the like, said frame section including generally cylindric peripheral support modules. The blank includes: (a) a quadrangular, particularly rectangular first edge panel section including two opposed straight sides and two opposed ends; (b) a pair of quadrangular, particularly rectangular face sections, each having two opposed straight sides and two opposed straight ends; (c) a quadrangular, particularly rectangular second edge panel section; and (d) a concavely shaped cutouts defining said opposed ends of each of said edge panel sections; (e) scoreline means for hingedly arranging said panel sections relative to each other to provide an open ended hollow quadrangular, particularly rectangular prism wherein the edge panel sections are preferably parallel with each other and the face sections are preferably parallel with each other; (f) fixing members for rigidly securing the panels to each other at a generally right-angled mutual position.

BRIEF DESCRIPTION OF THE DRAWINGS

The invention will be described by way of preferred embodiments with reference to the accompanying simplified, diagrammatic, not-to-scale drawings. It is particularly pointed out that the thickness of paperboard indications in the drawings is substantially exaggerated. This facilitates the understanding of how the particular blanks are folded in forming different panels for the furniture according to the present invention. In the drawings.

DESCRIPTION OF PREFERRED EMBODIMENTS

Figure 1:
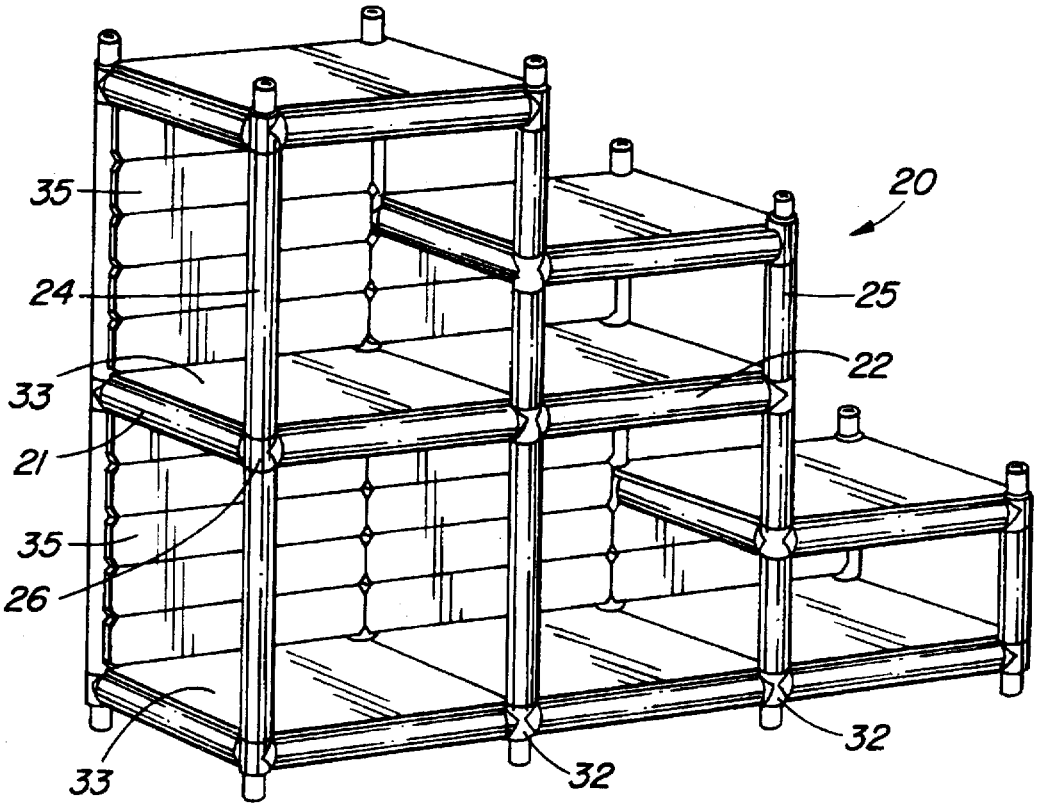
FIG. 1 is a perspective view of an assembled modular furniture unit including the features of the present invention.
Figure 2A:
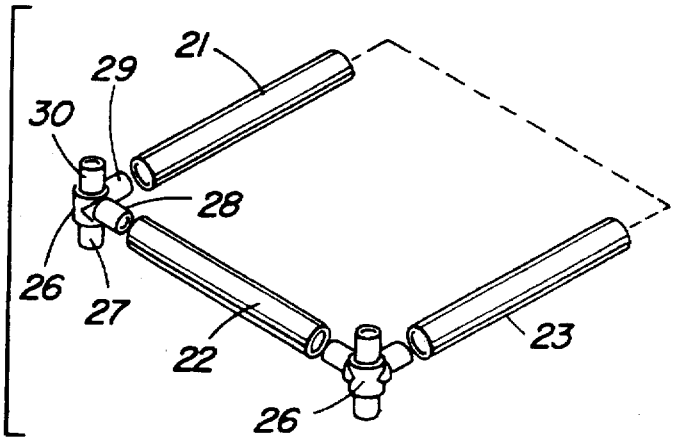
FIG. 2A is an exploded perspective view of a part of the modular furniture unit shown in FIG. 1.
Figure 2B:
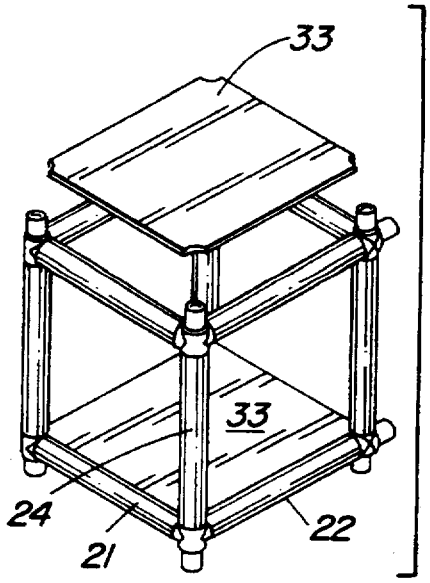
FIG. 2B is an exploded perspective view showing the arrangement of a shelf of known type in the frame of the modular furniture.

Turning firstly to the representation of FIGS. 1 and 2A, 2B, the kit of the present invention is shown as used in building a flower stand 20 it being understood that many other furniture units can be assembled from virtually the same kit components, for instance, a toy shelving unit, a serving table, a file room shelving unit, a desk etc.

The unit shown in FIG. 1 is assembled from a plurality of laminated paper tubes such as tubes 21, 22, 23, 24 and 25. In a typical arrangement, the tubes are made from a laminated paper having the grammage of about 180–250 g/m$^2$. They are preferably produced from recycled paper laminated to the wall thickness of about 2 mm or more. The production of paper tubes is well known in the art. It is not a part of the invention and therefore does not have to be described in detail. It is also to be appreciated that the tube does not have to be made from paper; it can be a plastic tube or even a paper tube with a plastic or metallic tube outside layer.

Figure 4:
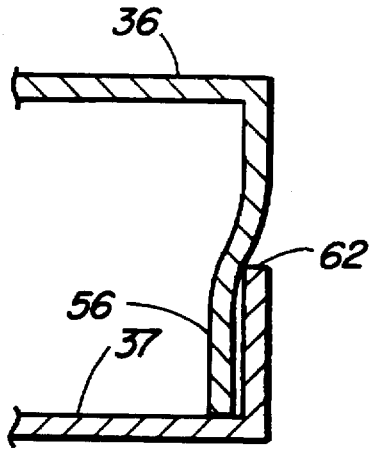
FIG. 4 is a sectional view taken along the line IV—IV of FIG. 3, on enlarged scale.
Figure 5:
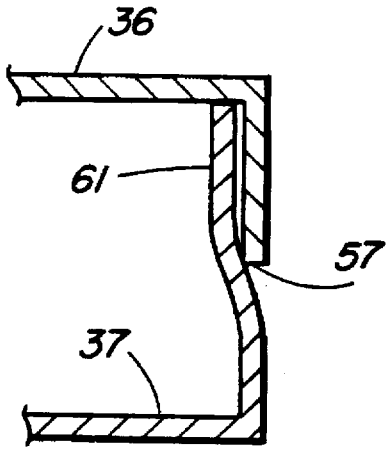
FIG. 5 is a sectional view taken along the line V—V of FIG. 4, on enlarged scale.

The tubes 21–25 are assembled to form a rectangular, three-dimensional frame structure as best seen in FIG. 1. To this end, the kit includes a number of corner connectors 26. The corner connector 26 shown is provided with a plurality, in the embodiment shown in FIG. 4 four, connecting stems 27–30 which are disposed at right angles to each other and are integral with a central body of the connector. The respective stems 27–30 are compatible for a firm grip, due to an interference fit or the like, or due to an adhesive or other suitable means, with the inside of the respective tubes 21–25 to form therewith a solid three-dimensional rectangular frame structure. Other connectors, having different number of stems, for instance five, such as connector 32, are also provided, depending on the location in the overall frame structure. The stems may be provided with serrations or the like projections improving the grip in the tube.

Figure 7A:
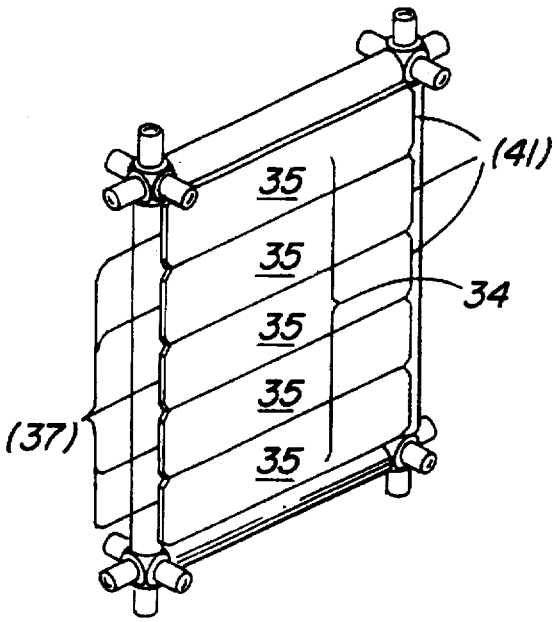
FIG. 7A is a simplified perspective view showing a part only of one partition wall utilizing one embodiment of the fill-in panel in accordance with the present invention.

The unit shown comprises a number of horizontal shelves 33 and, in the embodiment shown, a number of back wall panel arrangements 34 (FIG. 7A). The shelves 33 can be simply strong paperboard panels of rectangular shape with concavely cut out corners, placed on top of a particular arrangement of the horizontal system of the tubes. This arrangement, shown in FIG. 2B, which is known per se, however suffers from the drawbacks of relatively small strength of the shelf 33 limiting the usefulness of the modular furniture unit.

The fill-in panel arrangement of our invention presents an improved strength to the overall system, whether by way of support for the shelf sheet 33 (only the shelf sheet is shown), or by way of defining itself a shelf, a partition or a back wall of a furniture unit without any additional cover such as the shelf sheet 33.

Referring now to FIGS. 3–6, the preferred embodiment of the panel is made from a paperboard having the grammage of about 700 g/m$^2$ to about 1300 g/m$^2$, preferably made from recycled material. The surface of the paperboard may be provided with a protective layer or with an eye pleasing ornamentation, depending upon the particular modular unit to be built from same.

Figure 6:
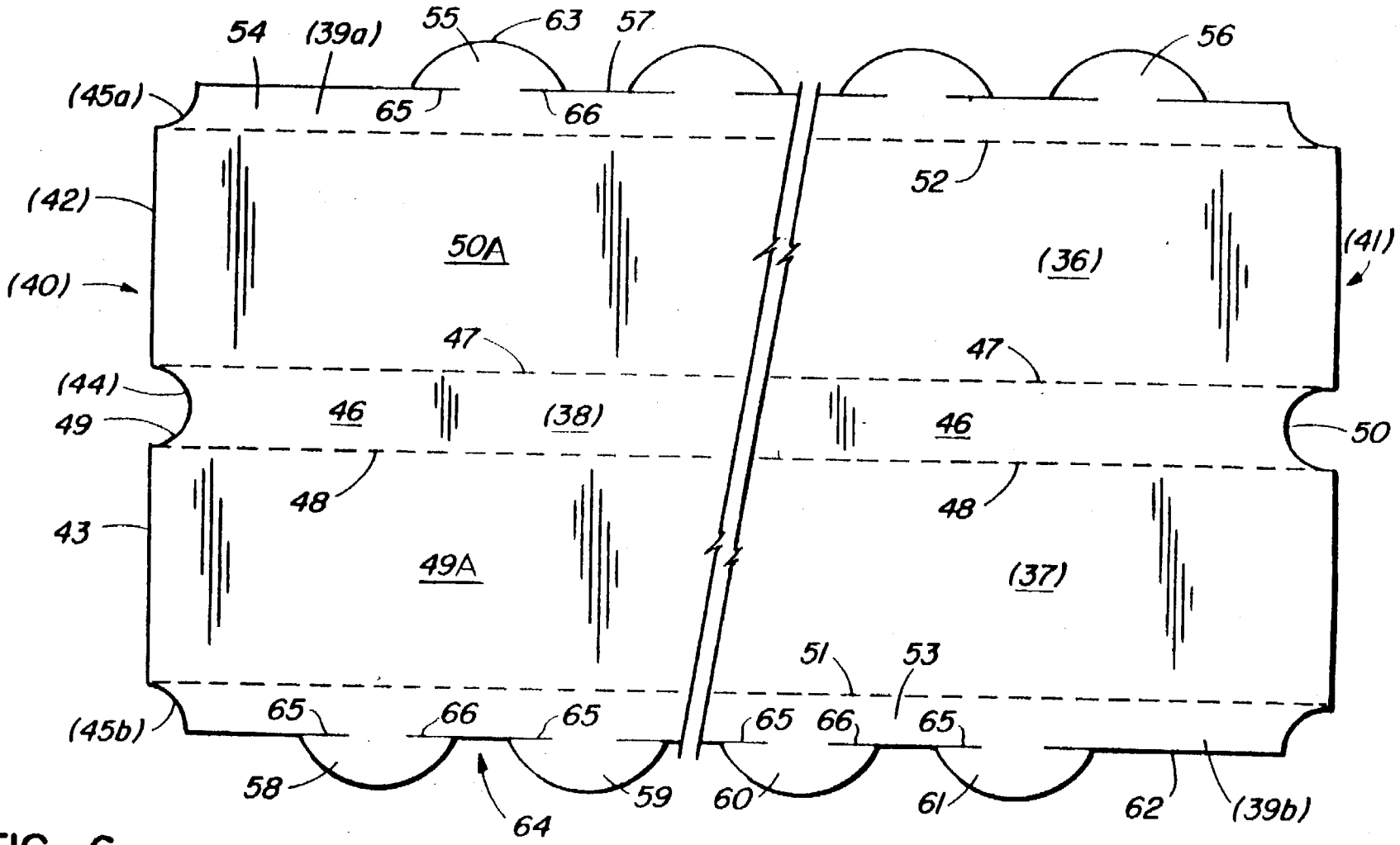
FIG. 6 is a top plan view of a blank for the production of the shelf or the like of FIG. 3.

The fill-in panel 35 is of rectangular configuration defined by two spaced-apart, parallel planar face boards 36, 37, and a pair of opposed edge wall portions 38, 39. The ends of the panel 35 are referred to as hollow edge sections 40, 41. As best seen from FIG. 3 and 6, the edge section 40 is defined by a first edge 42 of the top face board 36 and by a first edge 43 of the lower face board 37, by a semicircular, concavely rounded, semicircular end edge 44 of the edge wall portion 38, and by a second similarly concavely cut off rounded end edge 45 of the edge wall portion 39. FIG. 6 shows that, in the embodiment shown, the rounded edge 45 is composed of two portions 45*a*, 45*b*, each at the end of the respective portion 39*a*, 39*b* from which the edge wall portion 39 is composed. The opposite hollow edge section 41 is identical in structure and shape to that of 40 and therefore does not have to be described in detail.

It should be noted that the radius of the rounded edges 44, 45 corresponds to the outer radius of the tubes 21, 22 etc.

Turning now to the representation of FIG. 6, a blank from the above paperboard sheet having thickness of about 0.5 mm is shown from which the panel 35 is assembled. Certain basic parts of the blank are designated with same reference numbers as used in FIG. 3 but they are in parentheses when referred to in FIG. 6, to indicate which parts of the representation in FIG. 3 corresponds to the particular detail.

The blank shown in FIG. 6 comprises an elongated, generally rectangular first edge panel section 46 which is delimited by two opposed scorelines 47, 48 of the type of scorelines, and two semicircular, concavely curved end edges 49, 50. A pair of rectangular face sections or panels 49A, 50A hinged at scorelines 48, 47, to the first edge panel 46. The opposite side of panel 49A is defined by a scoreline 51 and that of panel 50A by a scoreline 52. Each scoreline 51, 52 defines a hinge between the respective face panel 49A, 50A and an adjacent edge wall subsection 53, 54.

In the embodiment of FIGS. 3–6, the edge wall subsections 53, 54 form a preferred arrangement of fixing members, also referred to as "joining elements," which are adapted to fixedly enclose the panels of the blank to define a hollow rectangular prism open at both ends. The fixing arrangement comprises a plurality of equidistantly spaced tabs of which only a small portion is shown in the drawings. In particular tabs 55, 56 (and a number of not shown similar tabs therebetween) project from the outer edge 57 of the edge wall subsection 54. A similar series of tabs 58, 59, 60, 61 (and a not shown plurality of similar tabs between the tabs 59 and 60) project from the outer edge 62 of the subsection 53. FIG. 6 shows that the tabs 55–56 are offset with respect to tabs 58–61 such that, viewed across the blank, for instance the peak 63 of tab 55 is opposite to the valley 64 between tabs 58 and 59. Each tab is provided with two linear incisions or cuts directed inwards of the respective tab from both sides and forming an extension of the respective edge 57, 62. The incisions 65, 66 of each adjacent pair of tabs, such as tabs 60, 61, are so dimensioned that their total length along the edge 62 corresponds to the maximum width of the opposed tab 56 which is its width at the respective outer edge 57. Accordingly, the tabs and the incisions interengage with each other to interengage the subsections 53, 54 into the edge wall portion 39, where the two edges 62, 57 are alternately visible on the outer surface of the edge wall portion 39 or hidden beneath the respective tab, where the other edge becomes exposed at the outside. Once interengaged, the system of tabs and cuts forms a firm joint enclosing the hollow rectangular structure of the panel 35.

Referring briefly to the representation of FIG. 7A, it is pointed out that, in the preferred embodiment, the width of the panel 35 is so selected that the system 34 of a number of panels 35 fills in a rectangular space defined in the frame structure. The panels 35 may be used only by themselves, or may form a reinforcement structure supporting a shelf sheet such as sheet 33 in FIG. 2B.

Those skilled in the art will readily appreciate that if it is decided to provide the rectangular panel structure from a single or multiple blanks of material such as paperboard, then a number of other structures of the blank may be considered.

Figure 8:
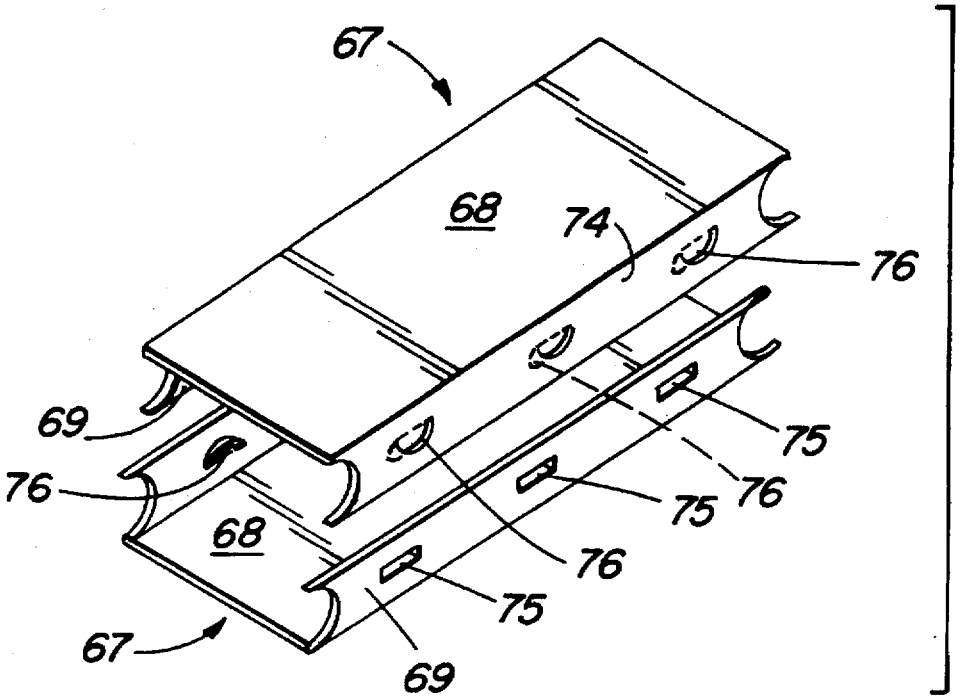
FIG. 8 is an exploded perspective view showing another embodiment of the shelf or the like panel for use in the unit of FIG. 1.
Figure 9:
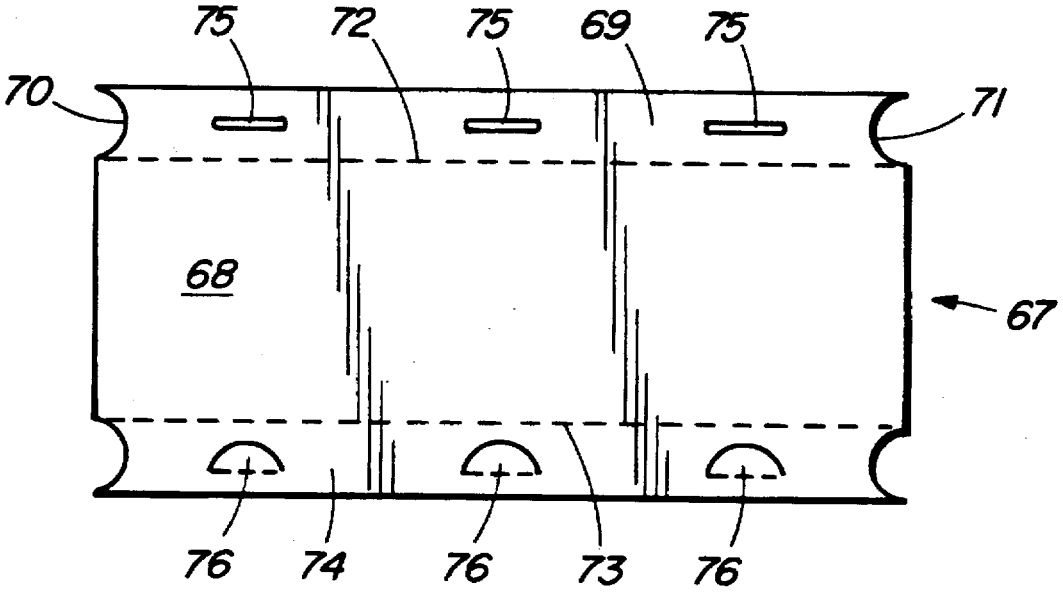
FIG. 9 is a top plan view of one of two blanks for building the shelf or the like panel of FIG. 5, the other panel being of an identical structure.

FIGS. 8 and 9 show one such modification of the structure of the blank system, where two blanks 67 are identically structured. As shown in FIG. 9, each blank 67 has a central rectangular surface panel 68 a first edge panel 69 which is generally rectangular except for concave semicircular end edges 70, 71. A scoreline 72 hingedly secures the edge panel 69 to the surface panel 68. At the opposite side, a similar scoreline 73 secures the surface panel 68 hingedly to a second edge panel 74 likewise having concavely curved end edges. The radius of the concavely curved end edges, of course, corresponds to the outer radius of the tubular members of the particular modular furniture assembly as discussed above.

FIGS. 8 and 9 indicate diagrammatically the presence of male and female locking arrangement. In particular, the first edge panel 69 is shown with a plurality of equidistantly spaced slots 75 while the second edge panel 74 has compatible rounded tabs 76. The two blanks are assembled together by engaging the tabs 76 with their counterpart slots 75. In the arrangement shown one of the edge panels 69, 74 of one blank is placed outside, and the other inside the assembled panel structure.

Figure 10:
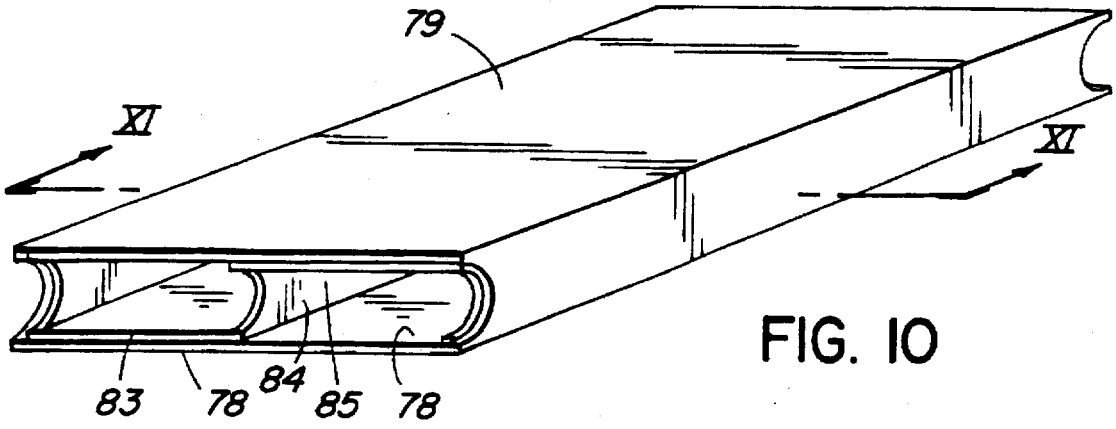
FIG. 10 is a perspective view of a third embodiment of the shelf unit of a yet another embodiment of the invention.
Figure 11:
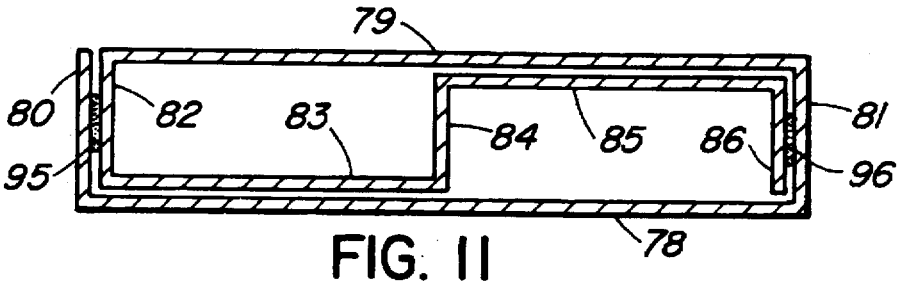
FIG. 11 is a sectional view taken along the line XI—XI of FIG. 10.
Figure 12:
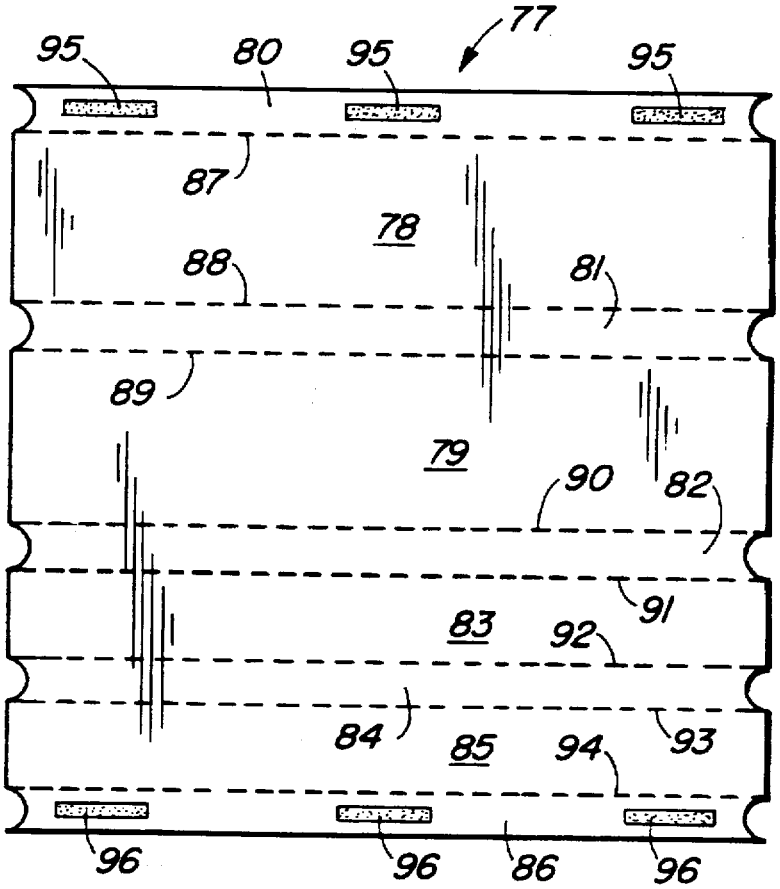
FIG. 12 is a top plan view of a blank for the production of the shelf or the like of FIG. 10.

In some instances it may be desired to provide the panel with an additional reinforcement and this again can be done in a number of variations one of which is shown in FIGS. 10–12.

The blank 77 is of a generally rectangular shape. It includes a first surface panel 78 and a second surface panel 79. One side of the first surface panel 78 is hinged, along a lateral score line 87, to a first edge panel 80 and, along a lateral score line 88, to a second edge panel 81. In assembled state the edge panels 80, 81 are outer panels as best seen in FIG. 11. A further scoreline 89 presents a hinged securement of the second edge panel 81 to one side of the second surface panel 79. The other side of panel 79 is hinged at the scoreline 90 to a first edge reinforcing panel 82, which, in turn, hinged at the scoreline 91 to a first face reinforcing panel 83. A scoreline 92 hingedly secures the panel 83 to a central reinforcement rib panel 84 (cf FIG. 11) which is succeeded, via scorelines 93, 94, by subsequent second face reinforcement panel 85 and the second edge reinforcement panel 86.

In this embodiment, the first edge panel 80 is provided with pressure sensitive adhesive patches 95 and the second edge reinforcement panel 86 with pressure sensitive patches 96. While the patches 95 are preferred to be located as shown, the set of patches 96 could be located elsewhere, for instance between the panels 79 and 85.

FIGS. 10 and 12 show that each of the edge panels 80, 81, 82, 84 and 86 is provided at both its ends with an inwardly rounded semicircular cutout for the purpose as described in connection with preceding embodiments.

It will be appreciated that the embodiment of FIGS. 10–12 presents a reinforced version of the panel shelf or the like panel for use in the present invention. It will also be appreciated that while a single reinforcement rib panel 84 is present in this embodiment, other embodiments can be designed which would have a number of spaced-apart reinforcement ribs. The reinforcement rib structure may also be made of a separate blank.

Figure 3:
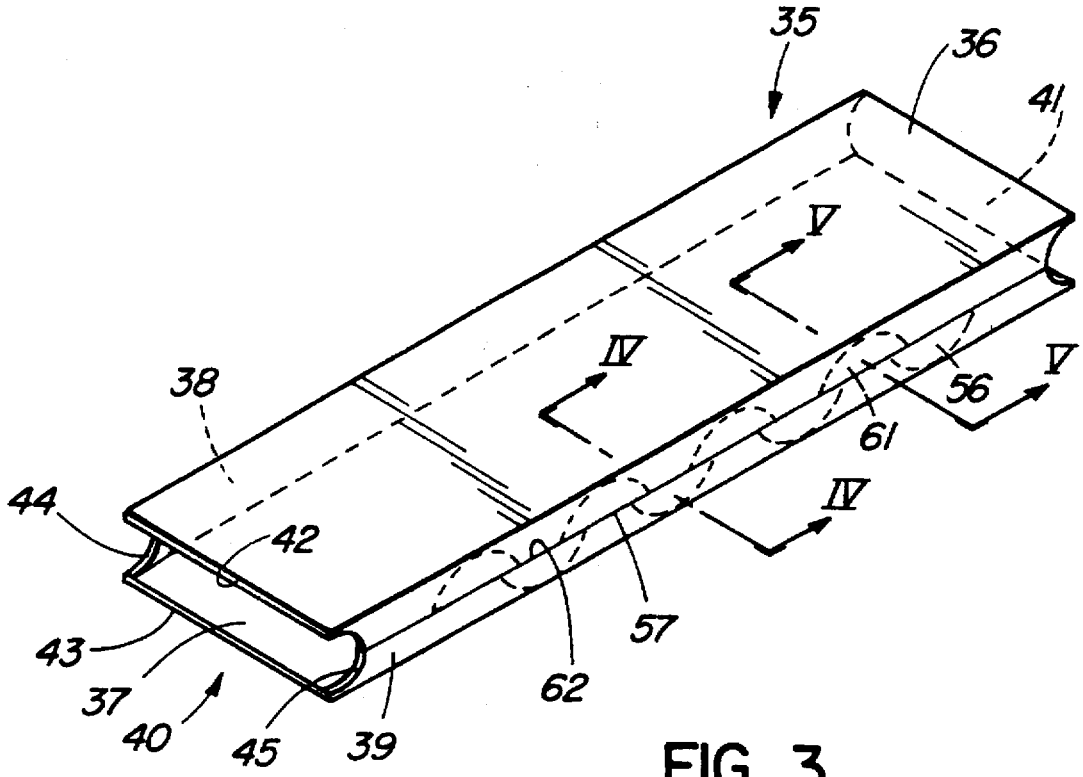
FIG. 3 is a perspective view of an assembled shelf or the like panel for use in the unit of FIG. 1.

The furniture kit including the panels shown in FIGS. 3, 8 or 10 described is assembled as indicated in FIG. 2A. That is to say, the respective rectangular frame subassembly of four tubes is only partly assembled by joining tubes 21, 22 and 23 with the respective corner connectors 26. Then, the respective assembled or finished panels, e.g. a number of panels 35, are inserted from the rear of FIG. 2A with the rounded cutouts 44, 45 and their opposed counterparts engaging the surface of tubes 21, 13, whereupon the rear tube (not shown in FIG. 2A is secured by two additional corner connectors (also not shown in FIG. 2A). While it is preferred that a number of panels such as panel 35 be used in each rectangular frame subassembly, the number is optional an may range from one to any practical number.

Figure 7B:
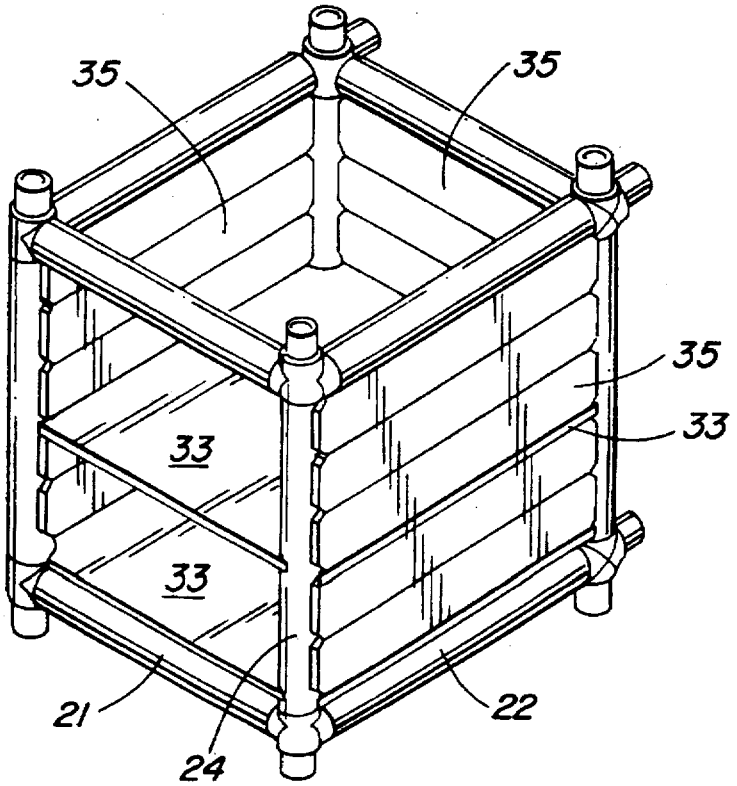
FIG. 7B is a perspective view showing how additional members, such as shelves or partitions, can be inserted between and held by two adjacent fill-in panels.

As shown in FIG. 7B, the narrow gaps or slots between the fill-in panels 35 can also be utilized for inserting therein a peripheral portion of a supplemental article such as a shelf of a structure similar to the shelf 33 shown in FIG. 2B. Another modification of the embodiments described is in replacing the rectangular shape of the fill-in panels 35 with one where the face panels would be trapezoidal (not shown in the drawings). Such arrangement, could provide an interesting visual appeal, for instance if the panels were provided with different ornamental motifs or color. The panels could be placed in the tubular frame with the wide and narrow ends of the trapezoidal panels alternatingly arranged along the respective side of the frame.

Similarly, if desired, the face panels could be made of different width whereby, in an assembled state, the edge panels would be convergent in the direction toward one of the face panels, giving the fill-in panel a trapezoidal contour in an end view. This could be used to provide bevelled longitudinal edges surrounding each gap between two adjacent fill-in panels. Such bevelled edges might provide visual compensation for minor inaccuracies in the assembly where the peripheral edge of a shelving unit would be placed between the panels.

The present invention thus provides an improvement whereby an inexpensive structure is provided of a shelf or other wall unit for the modular furniture described. The embodiments disclosed and their modifications can be modified or substituted by further embodiments without departing from the scope of the present invention.

Accordingly, we wish to protect by Letters Patent issued on this application all such embodiments as fairly fall within the scope of our contribution to the art.

We claim:

1. A modular furniture kit comprising:

(a) a plurality of open ended, generally cylindric tubular support modules;

(b) a plurality of angular connectors, each connector comprising a plurality of stems projecting from a center of the connector and disposed at right angles relative to each other, said stems being compatible in size with the tubular support modules for inserting each into one end of one of said support modules to thus connect two of said support modules to each other to form a three-dimensional structure comprising a plurality of rectangular frame sections disposed at right angles to one another;

(c) a plurality of fill-in panels, each fill-in panel being of a quadrangular prism-like configuration compatible with said support modules for securement of one or more of the panels in a selected one of said rectangular frame sections, each of said panels, when assembled, including:

(i) two spaced-apart, quadrangular and generally planar, opposed face boards comprised of a first board and a second board, said boards defining faces of said panel; and (ii) four peripheral edge portions comprised of:

(1) a pair of opposed edge wall portions integral with the first and/or second board and defining two opposed edges of the panel;

(2) a first rectangular hollow edge section defined by a first edge of each of said first and second boards and by a first end edge of each of said edge wall portions;

(3) a second generally rectangular hollow edge section opposed to the first edge section and defined by a second end edge of each of said first and second boards and by a second edge of each of said edge wall portions;

(iii) said first and second end edges of each of said edge wall portions being concavely rounded at a radius generally corresponding to the outside radius of the support modules of the respective frame section;

whereby, in an assembled state, the end edges of said edge wall portions engage the surface of the support modules at opposed sides of said rectangular frame section.

2. The kit of claim 1, wherein both the tubular support modules and the fill-in panels are made from paperboard.

3. The kit of claim 1, wherein each fill-in panel is of the type of an elongated prism made from a single blank adapted to be folded into a three-dimensional shape, the blank comprising (a) a rectangular central portion corresponding, in an assembled state, to one of the opposed edge wall portions;

(b) said one of the opposed edge wall portions being hingedly connected along both longitudinal sides thereof, with a first side of two main rectangular portions corresponding, in an assembled state, to said face boards of said prism;

(c) the second sides of said main rectangular portions being each hingedly connected along a further longitudinal bend with an outer section, (d) said outer sections being provided with joining elements for mutual connection of the outer sections such that, in a folded, assembled state, they define the other of said edge wall portions.

4. The kit of claim 3, wherein the joining elements are half-moon shaped tabs projecting from outer edges of said outer sections and provided each with a pair of straight incisions coextensive with the respective outer edge and extending into each tab from both sides thereof, the tabs being arranged in alternating fashion whereby a peak portion of the tab of one of the outer sections is placed opposite an intermediate portion of the other one of the outer sections, said intermediate portion being disposed between two adjacent tabs of the other one of the outer sections.

5. The kit of claim 2, wherein each fill-in panel is of the type of an elongated hollow prism open at both ends thereof, the prism being formed from a pair of channel-shaped halves each made from a blank, The halves having each a bottom portion and a pair of opposed longitudinal flange sections, the channel-shaped halves being inserted into each other with flange sections of the halves overlaying each other and said bottom portions defining spaced-apart faces of the fill-in panel, said halves being connected by way of tabs projecting from one of the flanges into a slot provided in an adjacent flange of the other half, whereby each of the edge wall portions is formed by two overlapped flanges, one of each of said halves.

6. The kit of claim 2, wherein an elongated reinforcement member having a generally S-shaped cross-sectional configuration is disposed inside fill-in panel and engages inside surfaces thereof.

7. The kit of claim 1, comprising a plurality of said fill-in panels, and supplementary fill-in elements adapted to be inserted in gaps between the fill-in panels.

8. The kit of claim 1, wherein the edge wall portions of the panel in an assembled state are divergent relative to each other in a direction toward one of the first and second boards, whereby the panel has a trapezoidal contour in an end view.

9. The kit of claim 1, wherein the face boards are trapezoidal such that the opposed edge wall portions are divergent relative to each other in the direction from said first hollow edge section to said second hollow edge section.

10. The kit of claim 1, wherein at least one of the face boards is provided with a decorative layer at an outside surface thereof.

11. A paperboard or the like blank system for providing a fill-in panel of a generally quadrangular configuration compatible with a rectangular frame section of modular furniture or the like, said frame section being comprised of generally cylindric peripheral support modules, said blank including:

(a) a generally rectangular first edge panel section including two opposed, straight sides and two opposed ends;

(b) a pair of quadrangular face sections, each having two opposed straight sides and two opposed straight ends;

(c) a generally rectangular second edge panel section; and (d) each of said opposed ends of each of said edge panel sections having the shape of a concave, generally semi-circular edge the radius of which corresponds to that of the outer surface of said peripheral support modules;

(e) scorelines hingedly arranging said panel sections relative to one another to provide an open ended hollow quadrangular prism wherein the edge panel sections are parallel with each other and the face sections are parallel with each other to define, on assembling the fill-in panel, a quadrangular prism-like structure open at both ends thereof;

(f) joining elements for joining selected panel sections one to another to maintain said quadrangular prims in an assembled state.

12. The blank system of claim 11 of the type of a single blank.

13. The blank system of claim 11 comprising a pair of identical blanks.

14. The blank system of claim 12, wherein:

(a) said first edge panel section is hinged at each side thereof to one side of each of said face sections;

(b) the second edge panel section is comprised of two second edge panel subsections, each hinged with its one side to the other side of one of said face sections and having an opposed free edge side, (c) the combined width of the subsections as measured between their sides being generally equal to the width of the first edge panel section;

(d) said joining elements being defined by a plurality of alternating tabs and tab receiving slits;

(e) said tabs being generally half-moon shaped and projecting from the free edge of each panel subsection at a generally equidistantly spaced apart, relationship in which there is an intermediate edge portion of the free edge of the respective panel subsection between each pair of adjacent tabs;

(f) the tabs of each of the opposed panel subsections alternate such that, viewed laterally, the tab of one panel subsection faces the respective intermediate portion of the free edge of the opposed panel subsection;

(g) said tab receiving slits are coextensive with the respective intermediate edge portion and extend by way of pairs of cuts into adjacent tabs such that the distance between the ends of the cuts corresponds to the maximum width of the tab of the opposed panel subsection.

15. The blank system as claimed in claim 13, wherein each of the blanks comprises:

(a) a quadrangular face section having two opposed sides and two opposed ends;

(b) a first side edge panel subsection hingedly secured by a first scoreline to one side of the face section and having concavely rounded end edges;

(c) a second side edge panel subsection hingedly secured by a second scoreline to the other side of the face section and having concavely rounded end edges;

(d) a plurality of tabs integral with the first side edge panel subsection disposed at a predetermined spacing along said first side edge panel subsection; and (e) a plurality of tab receiving slots in the second side edge panel subsection adapted to receive said tabs and disposed at the said predetermined spacing along said second side edge panel subsection;

whereby each of said blanks is adapted to form a channel-shaped member fixedly interengageable with the channel-shaped member formed from the other blank by engaging the tabs in the tab receiving slots to form therewith a hollow open-ended rectangular prism-like structure.

16. A panel of a generally quadrangular configuration for securement in a rectangular frame section of a modular furniture or the like structure, said frame section being defined by cylindric frame members, said panel defining the general shape of a flattened, hollow, quadrangular prism-like structure open at both ends and including:

(a) two spaced-apart, generally parallel and generally planar and quadrangular face boards comprised of a first board and a second board, said boards defining faces of said panel; and (b) four peripheral edge portions comprised of:

(1) a pair of opposed, generally solid edge wall portions integral with the first and/or second board and defining two opposed edges of the panel;

(2) a first generally rectangular hollow edge section defined by a first edge of each of said first and second boards and by a first end edge of each of said edge wall portions;

(3) a second generally rectangular hollow edge section opposed to the first edge section and defined by a second end edge of each of said first and second boards and by a second edge of each of said edge wall portions;

(c) said first and second end edges of each of said edge wall portions being concavely rounded at a radius generally corresponding to the outside radius of the support modules of said frame section.

17. A modular furniture unit comprising:

(a) a plurality of open ended, generally cylindric tubular support modules made from laminated paper-like material;

(b) a plurality of angular connectors, each connector comprising a plurality of stems projecting from a center of the connector and disposed at right angles relative to each other, said stems being firmly inserted in ends of the tubular support modules connecting said support modules to each other and forming a three-dimensional structure comprising a plurality of rectangular frame sections disposed at right angles to one another;

(c) a plurality of fill-in panels made from a paperboard, each fill-in panel being of a rectangular prism-like configuration, one or more of said fill in panels being secured in selected rectangular frame sections, each of said panels including:

(i) two spaced-apart, rectangular, parallel and generally planar, opposed face boards comprised of a first board and a second board, said boards defining faces of said panel; and (ii) four peripheral edge portions comprised of:

(1) a pair of parallel, opposed edge wall portions integral with the first and/or second board and defining two opposed edges of the panel;

(2) a first rectangular hollow edge section defined by a first edge of each of said first and second boards and by a first end edge of each of said edge wall portions;

(3) a second generally rectangular hollow edge section opposed to the first edge section and defined by a second end edge of each of said first and second boards and by a second edge of each of said edge wall portions;

(iii) said first and second end edges of each of said edge wall portions being concavely rounded at a radius corresponding to the outside radius of the support modules of the respective frame section;

whereby the end edges of said edge wall portions engage the surface of the support modules at opposed sides of said rectangular frame section.

* * * * *